United States Patent [19]

Shaffer

[11] Patent Number: 4,552,364

[45] Date of Patent: Nov. 12, 1985

[54] METHOD OF PLAYING STRATEGY GAME

[76] Inventor: Jeffery J. Shaffer, 313 East St., Oregon City, Oreg. 97045

[21] Appl. No.: 631,501

[22] Filed: Apr. 30, 1984

Related U.S. Application Data

[63] Continuation of Ser. No. 287,072, Jul. 27, 1981, abandoned, which is a continuation of Ser. No. 93,309, Nov. 13, 1979, abandoned.

[51] Int. Cl.[4] ..... A63F 3/02

[52] U.S. Cl. ..... 273/260

[58] Field of Search ..... 273/260, 262

[56] References Cited

U.S. PATENT DOCUMENTS

| | | | |
|---|---|---|---|
| 512,421 | 1/1894 | Wilson | 273/262 |
| 1,666,953 | 4/1928 | Tuttle et al. | 273/262 |
| 1,674,533 | 6/1928 | Templeton | 273/260 X |
| 4,005,866 | 2/1977 | Marcil | 273/260 X |
| 4,194,741 | 3/1980 | Rea | 273/243 |

FOREIGN PATENT DOCUMENTS

| | | | |
|---|---|---|---|
| 2408344 | 8/1975 | Fed. Rep. of Germany | 273/260 |
| 915468 | 11/1946 | France | 273/260 |

*Primary Examiner*—Richard C. Pinkham
*Assistant Examiner*—Scott L. Brown
*Attorney, Agent, or Firm*—Chernoff, Vilhauer McClung, Birdwell & Stenzel

[57] ABSTRACT

A board game in which two opposing sets of playing pieces are moved one at a time according to specific rules on a square board having 100 square playing spaces in alternating turns of play. Each set of playing pieces includes twenty playing pieces which are placed on the game board in an initial array, and a Home Stone playing piece which is placed upon the board at a later stage of play. The playing pieces are divided into ten different types, each type having different capabilities for movement or capture of opposing playing pieces. Each of the pieces initially arrayed upon the game board is capable of capturing any piece belonging to the opposing set, but the Home Stone playing piece of each set, which is placed upon the game board at a later stage of the game, is incapable of capturing opposing pieces. Captured pieces are removed from the game board, and the object of the game is to capture the Home Stone playing piece of the opposing set.

1 Claim, 12 Drawing Figures

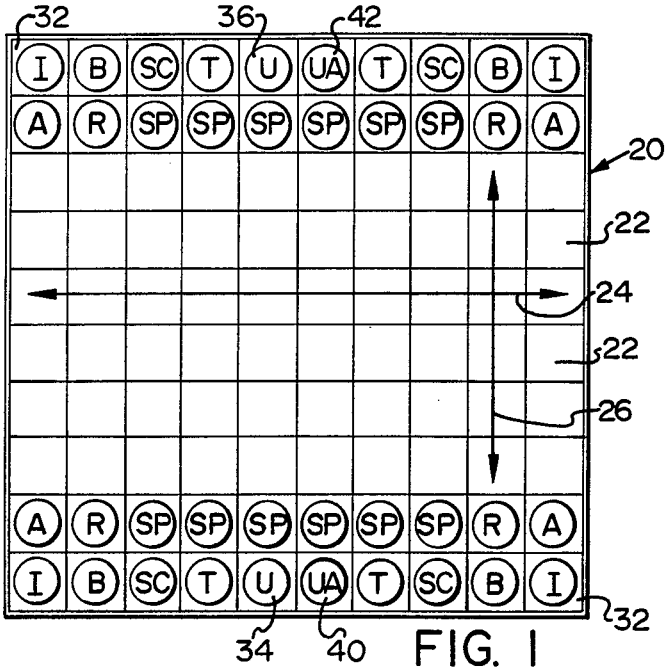
FIG. 1
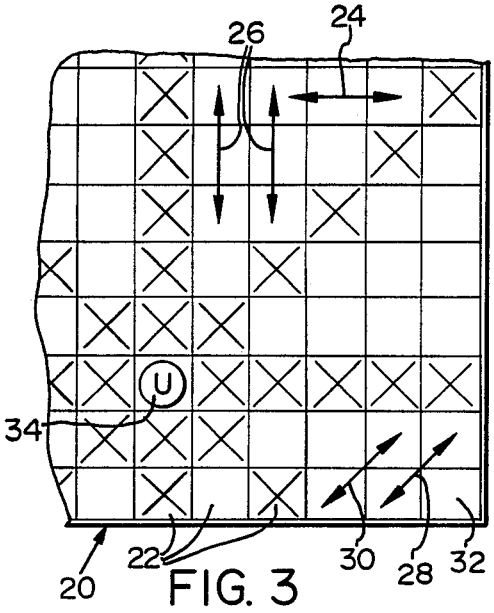
FIG. 3
FIG. 2
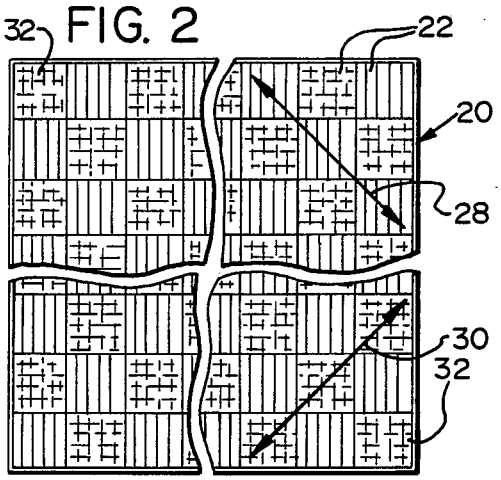
FIG. 4
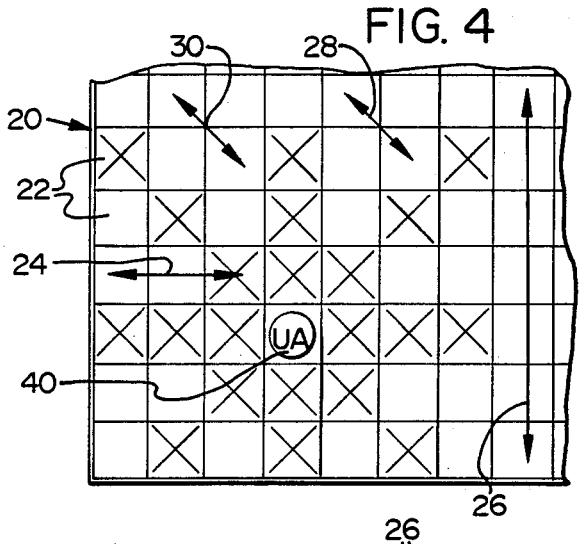
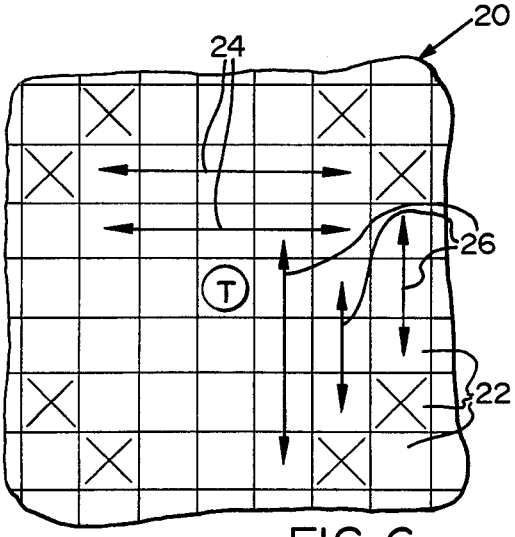
FIG. 6
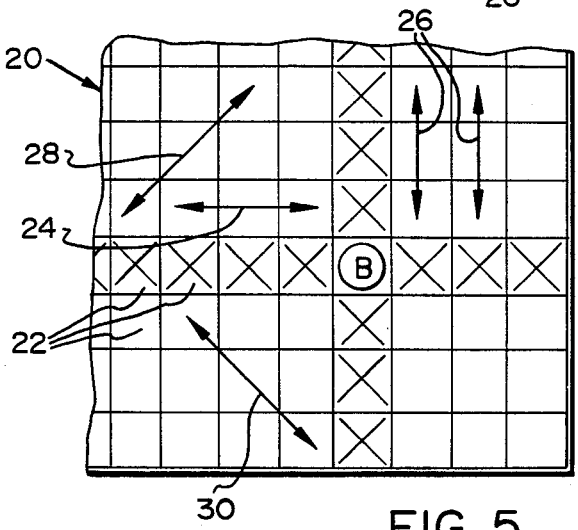
FIG. 5

FIG. 8
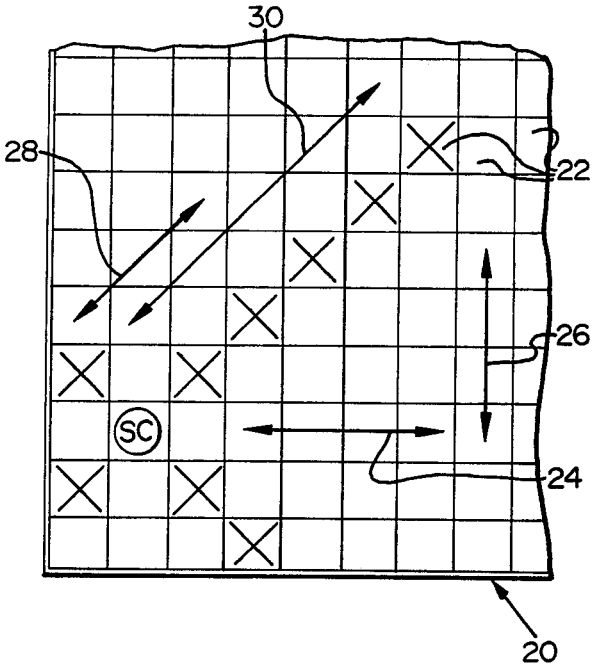
FIG. 7
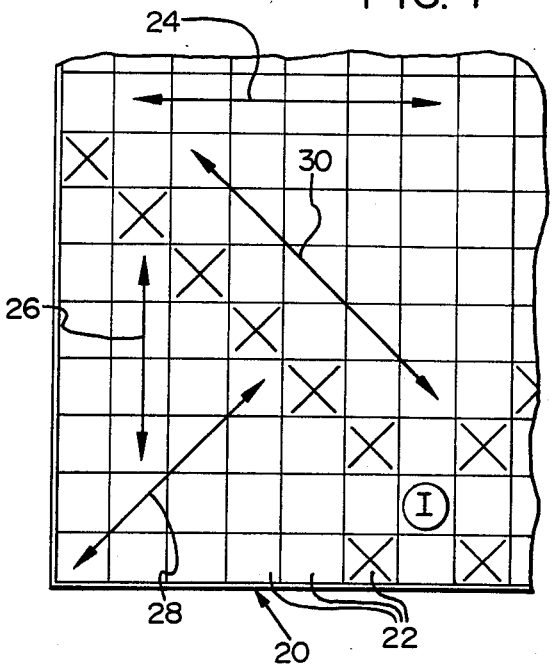
FIG. 11
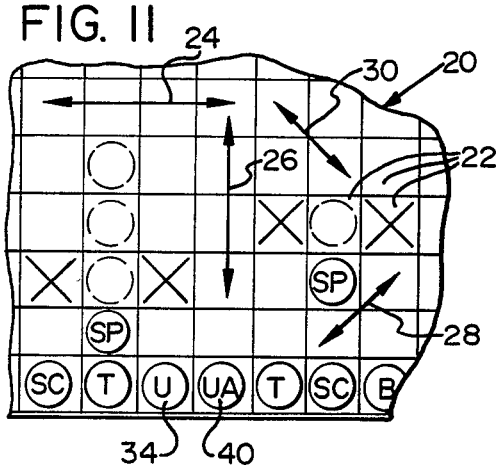
FIG. 10
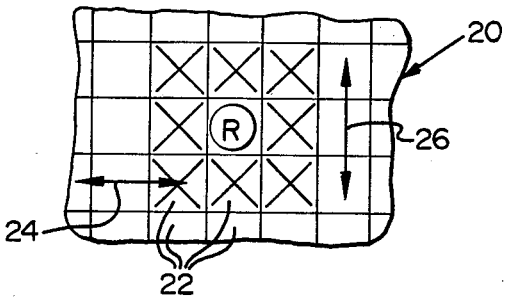
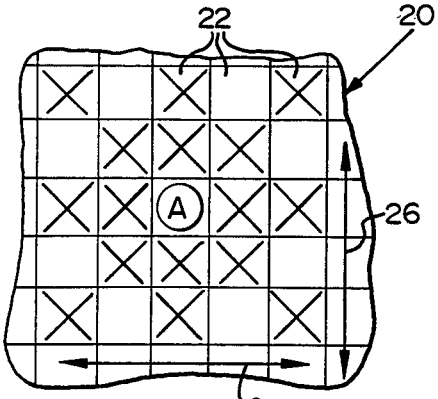
FIG. 9
FIG. 12
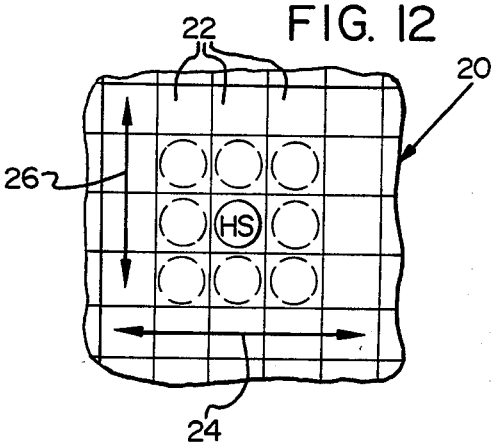

METHOD OF PLAYING STRATEGY GAME

This application is a continuation, of application Ser. No. 287,072, filed 7-21-81, which is a continuation of application Ser. No. 093,309 filed 11/13/79, both abandoned.

BACKGROUND OF THE INVENTION

This invention relates to a board game, and particularly to a board game for two opposing contestants, involving movement and capture of playing pieces.

Games of strategy and tactics requiring mental skill and planning abilities have long been popular forms of entertainment. For example, chess has for hundreds of years enjoyed a reputation as being an entertaining and intellectually stimulating board game of movement and capture. In a sense, however, chess is predictable, since the object of the chess game is to capture the king, whose position at the beginning of each game is always the same. As a result, the object of each game of chess is always clearly defined from the outset. Consequently, defensive strategy in the game of chess may be limited, and certain opening patterns of moves are often repeated.

While chess offers sufficient challenge and entertainment for many people, chess is too predictable for some. The number of useable options for the opening of the chess game is too limited for some, while others find the size of the chess board and the number of different types of playing pieces too limited.

In chess, pieces may be lost to an opponent, yet by moving a pawn to the far side of the playing board, a chess player may regain lost pieces. This capacity to recoup one's losses is felt by many to make chess too unrealistic for even a board game.

While in some games complexity is created by the use of cards which randomly impose unexpected and unpredictable limitations upon the moves of the player, such artificially enhanced complexity interjects an undesirable element of chance into a game which is otherwise a contest of intellects. The use of such "chance" cards is, then, undesirable as a means of adding challenge and complexity to a board game.

What is needed, therefore, is a competitive board game for two players which provides greater complexity and intellectual challenge than chess. It would be highly desirable to provide a broader choice of opening options, and a broad spectrum of defensive option, while maintaining a low level of predictability.

SUMMARY OF THE INVENTION

In response to the shortcomings and disadvantages of previously known board games, and in order to satisfy the aforementioned needs, it is a primary object of the present invention to provide an improved board game which is intellectually challenging.

It is another object of the present invention to provide an improved board game for two players which offers a satisfying level of complexity of play.

It is a further objective of the present invention to provide an improved board game which offers a wide variety of options in the planning of defense strategy.

It is yet a further objective of the present invention to provide an improved board game which is free from unrealistic opportunities for improvement of a player's position.

The present invention provides a game designed for play on a square game board which is subdivided into one hundred playing spaces arranged in ten ranks and ten files. Adjacent playing spaces on the game board are alternately colored as on a checkerboard.

Forty-two playing pieces are organized into two similar sets which are differentiable from one another, for example, by being of different colors. Each set of playing pieces comprises ten different kinds of playing pieces, representing various elements of a feudal city. Each kind of playing piece may be moved according to different rules as the two cities war against one another.

All except one of the playing pieces of each set are initially placed upon the game board in a predetermined array along the two ranks nearest each of two opposite sides of the game board. The single remaining playing piece of each set, called the Home Stone, may be placed upon the game board only between two predetermined number of moves.

The object of the game is to capture the Home Stone, and delayed placement of the Home Stone upon the game board adds an additional dimension of unpredictability and increased variety of opening strategies possible in playing the game. While each of the pieces initially arrayed upon the game board is capable of capturing any piece of the opposing set of pieces, the Home Stone, representing the heart of the city, is incapable of capturing an opposing piece.

An important feature of the present invention, therefore, is that a predetermined number of preliminary moves are made by the playing pieces of each of the opposing sets before the Home Stone piece, which must be captured to win the game, is placed upon the game board.

It is another important feature of the present invention that twenty one playing pieces, of ten different kinds each having different characteristic capabilities, may be moved according to the skill of the controlling players on a game board having one hundred playing spaces arranged in ranks and files.

It is an advantage of the present invention that it provides a game board of strategy, movement, and attack which is more intellectually challenging than the previously known board games.

It is another advantage of the present invention that it provides a board game which is more complex than previously known games of movement and strategy and which is free from artificially imposed restrictions.

It is yet another advantage of the present invention that it provides a board game which provides more freedom of choice with respect to game opening moves and initial defensive strategy than is provided by previously known board games.

The foregoing and other objectives, features and advantages of the invention will be more readily understood upon consideration of the following detailed description of the invention, taken in conjunction with the accompanying drawings.

BRIEF DESCRIPTION OF THE DRAWINGS

FIG. 1 is a plan view of an exemplary game board useable with the game of the present invention, with the two opposing sets of playing pieces located on the game board in the initial array for commencing play of the game.

FIG. 2 is a partially cut away view of the game board shown in FIG. 1, showing the preferred arrangement of colored playing spaces on the game board.

FIG. 3 is a diagrammatic view of a Ubar playing piece located on an exemplary portion of the game board shown in FIG. 1, showing the permissible moves of the Ubar playing piece.

FIG. 4 is a diagrammatic view of a Ubara playing piece located on an exemplary portion of the game board shown in FIG. 1, showing the permissible moves of the Ubara playing piece.

FIG. 5 is a diagrammatic view of a Builder playing piece located on an exemplary portion of the game board shown in FIG. 1, showing the permissible moves of the Builder playing piece.

FIG. 6 is a diagrammatic view of a Tarnsman playing piece located on an exemplary portion of the game board shown in FIG. 1, showing the permissible moves of the Tarnsman playing piece.

FIG. 7 is a diagrammatic view of an Initiate playing piece located on an exemplary portion of the game board shown in FIG. 1, showing the permissible moves of the Initiate playing piece.

FIG. 8 is a diagrammatic view of a Scribe playing piece located on an exemplary portion of the game board shown in FIG. 1, showing the permissible moves of the Scribe playing piece.

FIG. 9 is a diagrammatic view of an Assassin playing piece located on an exemplary portion of the game board shown in FIG. 1, showing the permissible moves of the Assassin playing piece.

FIG. 10 is a diagrammatic view of a Rider of the High Tharlarion playing piece located on an exemplary portion of the game board shown in FIG. 1, showing the permissible moves of the Rider of the High Tharlarion playing piece.

FIG. 11 is a diagrammatic view of a Spearman playing piece located on an exemplary portion of the game board shown in FIG. 1, showing the permissible moves of the Spearman playing piece.

FIG. 12 is a diagrammatic view of a Home Stone playing piece located on an exemplary portion of the game board shown in FIG. 1, showing the permissible moves of the Home Stone playing piece.

DETAILED DESCRIPTION OF THE INVENTION

Referring now to FIG. 1 of the drawings, an exemplary game board 20, suitable for playing the game of the invention may be seen to be subdivided into a matrix of 100 playing spaces 22 arranged in ten ranks 24 each having ten adjacent spaces arranged laterally across the game board 20, and ten files 26 comprised of ten adjacent spaces arranged vertically on the game board 20 as shown in FIG. 1.

The individual playing spaces 22 are preferably colored alternately red and yellow in a checkerboard pattern, as is indicated in FIG. 2, producing diagonals such as the red diagonal 28 and the yellow diagonal 30 in which all of the spaces diagonally adjacent to one another have the same color. The game board 20 is preferably placed between the two contestants so that a corner space 32, located at the right end of the rank closest to the contestant, is yellow.

In playing the game the two contestants take alternating turns, each moving a selected one of a respective set of playing pieces during each turn, according to specific rules governing the movement of each different type of playing piece. All except one of the pieces of each set can capture pieces of the opposing set. Any captured playing piece is removed from the game board 20 and takes no further part in the play of the game and the move of a piece which has just captured another ends where the capture is made.

The object of the game is to capture the "Home Stone" playing piece of the opposing set of playing pieces. The playing pieces used with the game of the invention are organized into two opposing sets of playing pieces, with each set comprising twenty one playing pieces representing various elements of a feudal city. Each set of playing pieces may be differentiated from the opposing set, as by distinguishing colors, with one set of playing pieces preferably being colored red and the other being colored yellow.

Referring now again to FIG. 1, the playing pieces are shown located on the game board 20 in an initial array from which play of the game is begun. A first, or yellow, set of playing pieces comprises a Ubar playing piece 34. The yellow Ubar 34 is initially positioned in the rank nearest the contestant controlling the yellow set of playing pieces, referred to as yellow's rear rank. It is placed initially in the fifth playing space 22 from the the left hand edge of the game board 20, as seen by the yellow contestant. A red Ubar 36 is located in the same file 26 as the yellow Ubar 34 and in the furthest rank 24 away from the yellow contestant, which may be called red's rear rank.

The Ubar is king of his respective city, and is the most powerful piece in the game. It is preferably represented as a man wearing a fur robe and a crown, and holding a sword. The Ubar may be moved in either direction along the rank, the file, or either of the diagonals passing through his position on the board, so far as each space over which he moves is unoccupied by any other playing piece (FIG. 3). Thus the Ubar 34 may move into any of the spaces 22 indicated by inscribed X's in FIG. 3, so long as each space into and through which the Ubar 24 passes is unoccupied. The Ubar 34 or 36 may capture any playing piece of the opposing set occupying a playing space 22 into which the Ubar 34 or 36 could move if the space were empty. Capture of an opposing playing piece ends the move of the Ubar, which remains in the playing space last occupied by the captured playing piece.

Located in the same rank as the yellow Ubar 34, in the fifth file from the right hand edge of the game board 20 as seen by the yellow contestant, is the yellow Ubara 40. Located in the same file, in red's rear rank, is a red Ubara 42. The opposing Ubars 34 and 36 are thus both in one file 26 and the opposing Ubaras 40 and 42 are both in an adjacent file 26, as indicated in FIG. 1. The Ubara 40 or 42, the Ubar's woman, is preferably represented as wearing a long dress and a small tiara crown, and having her hands folded in front of herself.

The Ubara 40 or 42 may be moved in either direction along the rank, the file, or either of the diagonals on which she is located, so long as each playing space 22 into or through which she passes is unoccupied and so long as she moves no more than three spaces in each turn (FIG. 4). The Ubara 40 shown in FIG. 4 may thus move into any playing space 22 having an included "X" in FIG. 4.

Similarly, the Ubara 40 or 42 may capture any playing piece of the opposing set by moving into a playing space 22 occupied by such an opposing playing piece, so long as she otherwise observes these limitations for moving. As with the Ubar, capturing an opposing playing piece also ends the movement of the Ubara 40 or 42 during that turn of play.

Also located in the rear rank of each set of playing pieces are a pair of Builders B of the respective colors, with each Builder B being located in the second file from a respective side of the game board 10. The Builder is preferably represented as a man wearing robes and a round hat or cap, and holding a scroll.

As indicated in FIG. 5 by X's inscribed in playing spaces into which he may move, each Builder B is free to move in either direction laterally along the rank 24, and either forward or backward along the file 26 in which he is located, so long as he moves only into or through playing spaces 22 which are not occupied by any other playing piece. The Builder B may capture a playing piece of the opposing set of playing pieces by ending his move in the space occupied by such an opposing playing piece.

A pair of Tarnsmen T are located in the rear rank of each set of playing pieces, with one Tarnsman T in the playing space 22 adjacent to the Ubar 34 or 36, respectively, and one Tarnsman T located in the space 22 adjacent to the Ubara 40 or 42 respectively. The Tarnsman is the Ubar's most probable right hand man, and is preferably represented as a man sitting on a giant hawk, holding reins controlling the hawk in his right hand and wearing a shield on his left arm. The Tarnsman may move, as indicated by X's inscribed in playing spaces 22 in FIG. 6, to any space separated from his present position by two ranks and three files, or three ranks and two files. A Tarnsman T may move to any of such playing spaces 26 which are unoccupied, regardless of the presence of other playing pieces in intervening playing spaces 22, such as the Builders B shown in FIG. 6. The Tarnsman is, then, the only kind of playing piece which is capable of jumping over intervening playing pieces. The Tarnsman may capture an opposing playing piece located in any playing space 22 to which the Tarnsman T may move, by moving to that playing space.

Located in each corner of the playing board, at the ends of the rear rank of each respective set of playing pieces, are the Initiates I, of which each set of playing pieces has two. The Initiates I are the high priests of the respective cities, and each is preferably represented as a man wearing robes and a cap having a cross on its top.

As indicated by X's inscribed in playing spaces 22 in FIG. 7, the Initiate I may move in either direction along either diagonal passing through its position. Each Initiate I is thus restricted to movement upon playing spaces 22 of a single color, with each city having one Initiate I on yellow diagonals 30 and the other on red diagonals. The Initiate may move as indicated in FIG. 7, insofar as each playing space 22 into an through which he passes is not occupied by any other playing piece.

As with the previously mentioned kinds of playing pieces, the Initiate I may capture any opposing playing piece located in a playing space 22 into which he could otherwise move, by moving into that playing space 22.

Completing the rear rank of each respective city, in the files 26 third from each side of the game board 10 and thus located between a Tarnsman T and a Builder B, are a pair of Scribes SC. The Scribe SC preferably is represented as a man wearing robes and carrying a ledger in his left hand and a stylus in his right hand.

As indicated in FIG. 8, the permissible movements of the Scribe SC are similar to those of the Initiate I, except that the Scribe SC is limited to a maximum of five spaces in each turn of play, as indicated by the X's inscribed in the playing spaces 22 to which the Scribe SC shown in FIG. 8 may move. As with the Initiates I, one Scribe of each city moves on red playing spaces 22 and the other moves on the yellow spaces.

Located initially in the forward rank of each city, that is, the second rank 24 from each contestant, an Assassin A is located in the file 26 nearest each side of the game board 20. Each Assassin A may preferably be represented as a man holding a dagger.

The Assassins A, as indicated in FIG. 9, may move in either direction along either the rank, the file, or either of the diagonals passing through its position, but no further than two playing spaces 22 in each turn, so long as each space 22 into or through which it passes is unoccupied by any other playing piece. As with the previously mentioned playing pieces, the Assassin A may capture an opposing playing piece situated in a playing space 22 into which he is otherwise able to move, by moving into the playing space 22 occupied by the opposing piece.

Also located in the forward rank 24 of each city, the second rank 24 from each contestant, in the playing spaces 22 adjacent to those occupied by the Assassins A, each city or set of playing pieces includes a pair of Riders of the High Tharlarion, or Lizard Riders R. A Rider R is preferably represented as a man astride a giant lizard, wearing a shield on his left arm, and holding reins in his left hand and a lance in his right hand. The Rider R may be moved into any unoccupied playing space 22 adjacent to the one in which it is located, as indicated by X's inscribed in playing spaces 22 in FIG. 10. Similarly, the Rider R may capture any opposing playing piece located in such an adjacent playing space 22.

Initially occupying the center six playing spaces 22 of the initial forward rank of each city are six Spearmen SP of each set of playing pieces. Each Spearman SP may move, on its initial move from the position indicated in FIG. 1, at the option of the contestant either one, two, or three spaces forward, toward the opposing city, so long as each playing space 22 into or through which the Spearman SP moves is unoccupied by any other playing piece. On subsequent moves each Spearman SP may move one space directly forward, remaining in the same file 26, if the playing space 22 into which it will move is unoccupied by any other playing piece. Thus the yellow Spearman SP shown in the playing space 22 ahead of the Tarnsman T in FIG. 11 may in its first move proceed to any of the playing spaces in that file 26 having an inscribed broken circle. The yellow Spearman SP in the same file as the Scribe SC may, however, move only one space forward to the playing space 22 including a broken circle, since that Spearman SP has already made its initial move.

The Spearman SP may capture an opposing playing piece only if the opposing piece is located in one of the adjacent spaces diagonally forward of the Spearman SP, as indicated in FIG. 11, where each yellow Spearman SP may capture an opposing playing piece located in either of the playing spaces 22 diagonally adjacent to the respective Spearman SP and including an X.

Referring to FIG. 12, the permissible moves of the Home Stone HS may be seen. The Home Stone HS is not initially placed on the game board 20, but once on the game board the Home Stone may move one space in either direction along the rank, the file, or either diagonal passing through its position, so long as the space into which it moves is unoccupied by any other playing piece. The Home Stone HS in FIG. 12 may thus move into any of the playing spaces 22 having an inscribed circle. The Home Stone HS may not capture any other playing piece.

In playing the game of the present invention, the contestants alternatingly each move any one of the playing pieces of their respective cities. The contestant controlling the yellow set of playing pieces is always first to move. He may move any one of his playing pieces, according to the limitations of movement of that playing piece as previously explained.

Next, the contestant controlling the red pieces moves any one of his playing pieces according to the limitations of the particular playing piece chosen. Play continues alternatingly in this fashion, with each contestant moving, in turn, a piece of his choice, in response to his opponent's moves and in accordance with his own strategy and tactics.

Each player, after completing seven moves, but no later than his tenth move, must place his city's Home Stone playing piece HS on the game board 20 in his city's rear rank in a playing space 22 which has been vacated by movement of the playing piece which originally occupied that space. Placement of the Home Stone playing piece HS is counted as one turn for the contestant. If a contestant fails to place the Home Stone after his seventh turn but no later than his tenth turn, he forfeits the game.

Once the Home Stone of one city has been placed on the game board 20, the opposing city directs its strategy tactics to capture the Home Stone. When one city captures the Home Stone of the other city, the city capturing the Home Stone has won the game.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of playing a board game comprising:

(a) providing a game board having a predetermined matrix of playing spaces arranged in ranks and files;

(b) providing distinguishable first and second opposing sets of playing pieces;

(c) providing two additional playing pieces, one of said additional playing pieces being identifiable with each of said sets of playing pieces and being distinguishable from each of the individual playing pieces in said set;

(d) completely filling a predetermined number of ranks of said spaces with playing pieces from each of said sets;

(e) moving a single playing piece of said first set on said game board according to predetermined rules of play;

(f) moving a playing piece of said second set on said game board according to said rules of play;

(g) alternatingly repeating steps (e) and (f);

(h) after repeating steps (e) and (f) a first predetermined number of times greater than zero, and before repeating steps (e) and (f) a second predetermined number of times greater than said first predetermined number of times, placing said respective additional playing pieces on said game board in any space not then occupied by one of said playing pieces; and (i) thereafter alternatingly repeating steps (e) and (f) until one of said additional playing pieces has been captured by movement of one of said playing pieces from the opposing set onto the space occupied by said additional playing piece.

* * * * *

UNITED STATES PATENT AND TRADEMARK OFFICE

CERTIFICATE OF CORRECTION

PATENT NO. : 4,552,364

DATED : November 12, 1985

INVENTOR(S) : Jeffery J. Shaffer

It is certified that error appears in the above-identified patent and that said Letters Patent is hereby corrected as shown below:

Col. 5 Line 51 Change "into an" to --onto and--.

Signed and Sealed this

*Twenty-fifth* Day of *March 1986*

[SEAL]

*Attest:*

DONALD J. QUIGG

*Attesting Officer*

*Commissioner of Patents and Trademarks*